US009193148B2

(12) United States Patent
Kubota

(10) Patent No.: US 9,193,148 B2
(45) Date of Patent: Nov. 24, 2015

(54) PRINTED MATERIAL INSPECTION SYSTEM AND CONTROL METHOD THEREOF

(71) Applicant: CANON KABUSHIKI KAISHA, Tokyo (JP)

(72) Inventor: Tsutomu Kubota, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 80 days.

(21) Appl. No.: 13/905,439

(22) Filed: May 30, 2013

(65) Prior Publication Data

US 2013/0321517 A1 Dec. 5, 2013

(30) Foreign Application Priority Data

Jun. 5, 2012 (JP) ..... 2012-128401

(51) Int. Cl.
*B41F 33/00* (2006.01)
*B42C 19/02* (2006.01)
*G03G 15/00* (2006.01)

(52) U.S. Cl.
CPC ..... *B41F 33/00* (2013.01); *B42C 19/02* (2013.01); *G03G 15/50* (2013.01); *G03G 15/6538* (2013.01); *G03G 15/5062* (2013.01)

(58) Field of Classification Search
USPC ..... 399/15–23, 407
See application file for complete search history.

(56) References Cited

U.S. PATENT DOCUMENTS

2011/0020015 A1* 1/2011 Nishimura et al. ..... 399/13
2011/0129239 A1* 6/2011 Kubota ..... 399/16
2012/0228372 A1* 9/2012 Kubota ..... 235/3

FOREIGN PATENT DOCUMENTS

JP 4470500 A 3/2010

* cited by examiner

*Primary Examiner* — Stephen Meier
*Assistant Examiner* — Renee I Wilson
(74) *Attorney, Agent, or Firm* — Fitzpatrick, Cella, Harper & Scinto

(57) ABSTRACT

A printing system according to one aspect of the present invention includes a plurality of post-processing apparatuses that perform post-processing on a printed sheet, at least one inspection apparatus connected between the plurality of post-processing apparatuses that inspects the printed sheet, and a control apparatus that performs control for receiving a job and executing processing according to the job; the printing system sets an inspection item to be inspected by the inspection apparatus based on configuration information indicating an anteroposterior relationship between the inspection apparatus and the post-processing apparatuses in the job relative to a flow of the printed sheet, and based on the post-processing apparatuses to be used in the job. The inspection apparatus performs the inspection in accordance with the set inspection item.

5 Claims, 14 Drawing Sheets

FIG. 8A

JOB 1

| | | DETAILS |
|---|---|---|
| SHEET FEEDING UNIT | DECK 1 | L |
| MULTI-INSERTER UNIT | Y | U:XX PAPER |
| PUNCHER UNIT | Y | 26 HOLES |
| INSPECTION UNIT | Y | → |
| STACKER UNIT | Y | – |
| CASE-BINDING UNIT | N | – |
| FOLDING UNIT | N | – |
| TRIMMER UNIT | N | – |
| STAPLING | N | – |
| TRAY | N | – |

FIG. 8B

MULTI-INSERTER

| | |
|---|---|
| INSERT DECK 1 | XX PAPER |
| INSERT DECK 2 | – |
| INSERT DECK 3 | – |

INSPECTION UNIT

| | INSPECTION LEVEL |
|---|---|
| SLANTING | A |
| BLURRING | B |
| SOILING | A |
| FRONT/BACK IDENTIFICATION | B |
| INSERT PAPER | A |
| PUNCH | B |
| TRIMMING | - |

PRINTED MATERIAL INSPECTION SYSTEM AND CONTROL METHOD THEREOF

BACKGROUND OF THE INVENTION

1. Field of the Invention

The present invention relates to a printed material inspection system including a post-processing apparatus that performs post-processing on a printed material and an inspection apparatus that inspects the printed material, and to a control method for such a system.

2. Description of the Related Art

There have thus far been on-demand printing systems that process a series of print jobs by printing using an electrophotographic- or inkjet-type printing apparatus and providing a post-processing apparatus that supplies paper, discharges paper, performs post-processing on printed paper, and so on in a stage previous to or following the printing apparatus. A variety of accessory devices are attached to the printing apparatus. Such accessory devices include, for example, sheet feeding decks for supplying various types of paper that are set therein, punchers for punching holes in paper, inserters for inserting printed paper, folders for folding paper, trimmers for cutting paper, stackers for arranging paper, and so on. Although whether or not each type of accessory device will be attached can be determined as desired, the position (order) in which the devices are attached is set in advance in the system, and a printing system is configured by attaching the devices according to that order. This is because respective accessory devices handle the post-processing that is performed on the printed paper, and because the order in which the accessory devices are disposed is set based on the final state of the printed material (for example, whether or not the printed material will be bound).

A printed material inspection apparatus that automatically inspects whether or not a printed material is soiled or the like by reading an image on the printed material using a camera, a line scanner, or the like has been proposed as one such accessory device. For example, Patent Document 1 (Japanese Patent No. 4470500) discloses making it possible to set a quality determination standard for images for each of different types of print media, in the case where a printed material in which various types of print media, such as copy paper, Japanese paper, and pre-print paper that is ruled, are intermixed is to be inspected.

However, the invention disclosed in the aforementioned Patent Document 1 does not consider adding an inspection apparatus that inspects images on printed materials to a printing system to which various accessory devices are attached. Unlike the aforementioned accessory devices, it is necessary to change the details of the processing performed by the inspection apparatus depending on where the inspection apparatus is connected. It is generally necessary for the inspection apparatus to be located after the final accessory device and inspect the printed material when the printed material is close to the final product stage. However, depending on the processing performed by an accessory device, there are cases where the printed material cannot be inspected after that processing. For example, if a binding process that folds the printed material or staples the printed material is carried out, images on that printed material cannot be read and inspected. In addition, in the case where holes are punched in the printed material using a puncher, it is necessary to change the details of the inspection depending on whether the inspection apparatus is in a stage previous to or following the puncher.

SUMMARY OF THE INVENTION

An object of the present invention is to eliminate the above-mentioned conventional problems.

A feature of the present invention is to increase the freedom with which an inspection apparatus can be disposed and thus increase the convenience for a user by setting an inspection item based on a post-processing apparatus used in a job and on information of a connection between the post-processing apparatus and the inspection apparatus, and carry out inspection in accordance with the stated setting.

According to one aspect of the present invention, there is provided a printed material inspection system including a plurality of post-processing apparatuses that perform post-processing on a printed sheet, at least one inspection apparatus connected between the plurality of post-processing apparatuses that inspects the printed sheet, and a control apparatus that performs control for receiving a job and executing processing according to the job, the system comprising: a setting unit configured to set an inspection item to be inspected by the inspection apparatus based on configuration information indicating an anteroposterior relationship between the inspection apparatus and the post-processing apparatuses in the job relative to a conveyance direction of the printed sheet, and based on the post-processing apparatuses to be used in the job; and an instruction unit configured to instruct the inspection apparatus to perform inspection in accordance with the inspection item set by the setting unit.

According to another aspect of the present invention, there is provided a control method that controls a printed material inspection system including a plurality of post-processing apparatuses that perform post-processing on a printed sheet, at least one inspection apparatus connected between the plurality of post-processing apparatuses that inspects the printed sheet, and a control apparatus that performs control for receiving a job and executing processing according to the job, the method comprising: a setting step of setting an inspection item to be inspected by the inspection apparatus based on configuration information indicating an anteroposterior relationship between the inspection apparatus and the post-processing apparatuses in the job relative to a conveyance direction of the printed sheet, and based on the post-processing apparatuses to be used in the job; and an instruction step of instructing the inspection apparatus to perform inspection in accordance with the inspection item set in the setting step.

According to the present invention, the freedom of a position in which an inspection apparatus is disposed can be increased, and thus the convenience for user can be increased as well.

Further features of the present invention will become apparent from the following description of exemplary embodiments (with reference to the attached drawings).

BRIEF DESCRIPTION OF THE DRAWINGS

FIGS. 8A and 8B are diagrams illustrating setting examples for accessory devices and multi-inserters when processing a job 1.

DESCRIPTION OF THE EMBODIMENTS

Embodiments of the present invention will now be described hereinafter in detail, with reference to the accompanying drawings. It should be noted that the following embodiments are not intended to limit the scope of the appended claims, and that not all the combinations of features described in the embodiments are necessarily essential to the solving means of the present invention.

Figure 1:
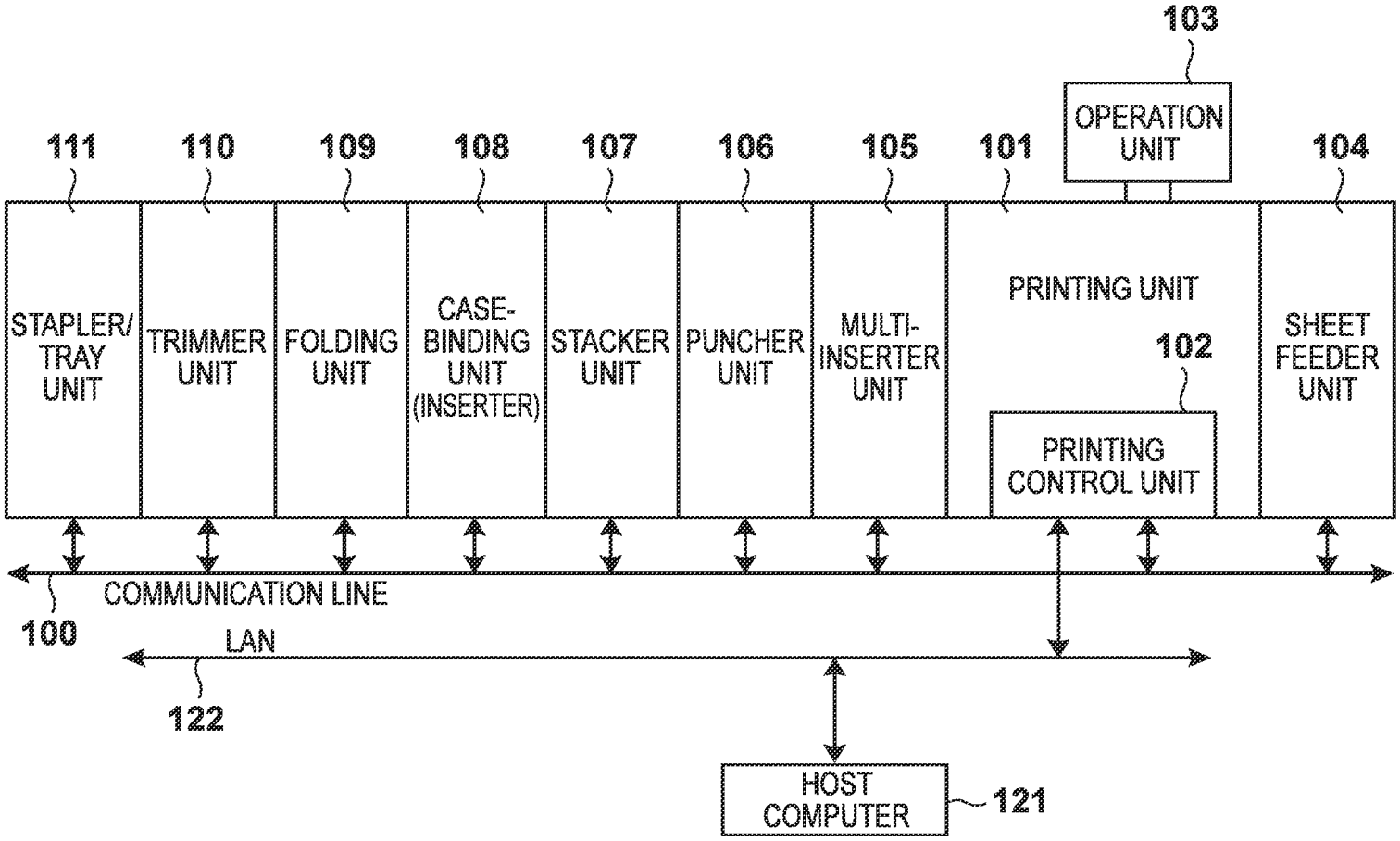
FIG. 1 is a block diagram illustrating the configuration of an on-demand printing system according to an embodiment of the present invention.

FIG. 1 is a block diagram illustrating the configuration of an on-demand printing system (printed material inspection system) according to an embodiment of the present invention. Here, accessory devices used for various types of post-processing are attached to a printing unit 101.

A communication line 100 is used to carry out communication between a main body of the system (that is, the printing unit 101) and the accessory devices. The printing unit 101 prints onto paper supplied from a sheet feeding unit 104. A printing control unit 102 creates image data by analyzing print data received from a host computer 121, and also controls the printing unit 101 and communicates with the respective accessory devices via the communication line 100. An operation (UI) unit 103 displays information regarding the printing system in a display unit, and also includes various types of keys and the like used by a user to make printing settings. The sheet feeding unit 104 supplies paper for printing to the printing unit 101. A multi-inserter unit 105 is used to insert paper printed by another printing apparatus, divider sheets, and so on. A puncher unit 106 punches holes used for filing in printed paper that has been printed onto by the printing unit 101. A stacker unit 107 aligns, stacks, and holds the printed paper. A case-binding unit 108 inserts a sheet that serves as a cover into the paper printed by the printing unit 101 from the multi-inserter unit 105, and performs saddle stitching, case-binding, and so on. A folding unit 109 performs folding processes, such as Z folds, on the printed paper. A trimmer unit (cutting unit) 110 cuts off excess areas of the printed paper. A stapler/tray unit 111 aligns and holds the printed paper, and also performs a stapling process using staples. The host computer 121 outputs print data and the like to the printing unit 101. A LAN 122 connects the host computer 121 to the printing control unit 102 of the printing unit 101.

Figure 2:
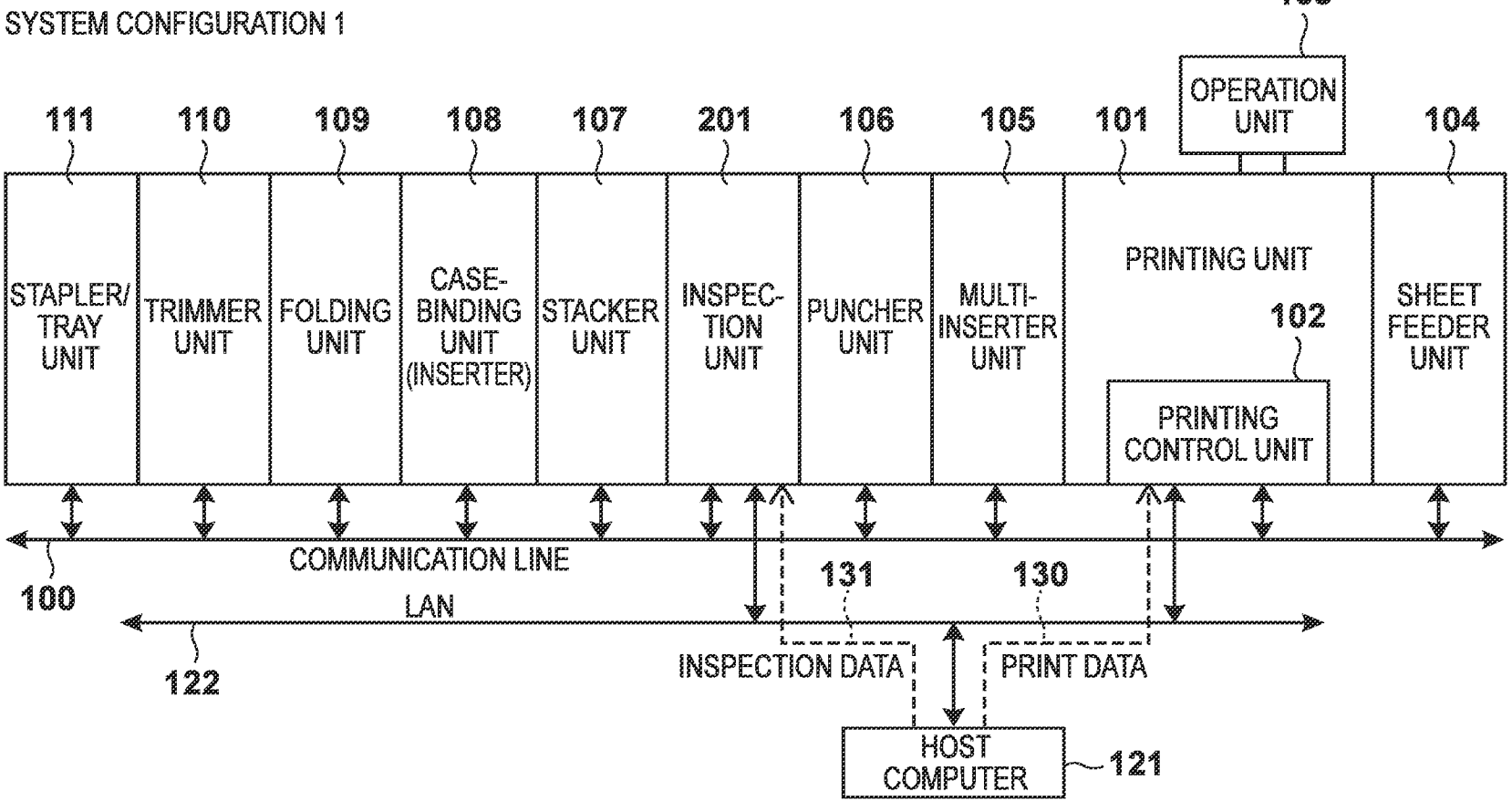
FIG. 2 is a block diagram illustrating a system configuration 1 in which an inspection unit for inspecting an image on a printed material has been added to the printing system.
Figure 3:
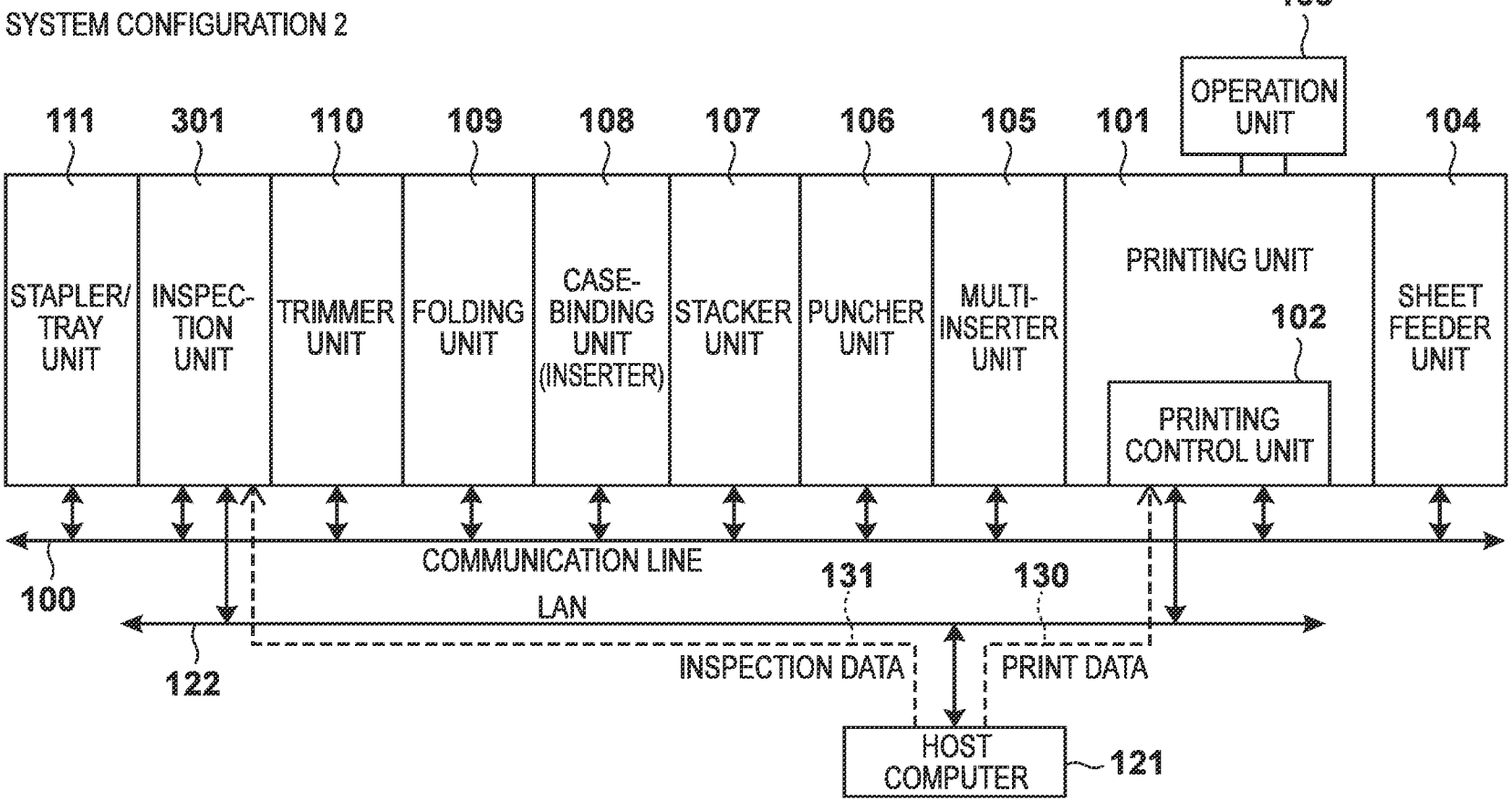
FIG. 3 is a block diagram illustrating a system configuration 2 in which an inspection unit for inspecting an image on a printed material has been added to the printing system.

FIGS. 2 and 3 are block diagrams illustrating the configuration of a system realized by adding an inspection apparatus (inspection unit) for inspecting an image on a printed material to the printing system illustrated in FIG. 1. Note that in FIGS. 2 and 3, the same reference numerals are given to elements that are the same as those shown in FIG. 1, and descriptions thereof will be omitted.

In a system configuration 1 shown in FIG. 2, an inspection unit 201 is connected between the puncher unit 106 and the stacker unit 107. Meanwhile, in a system configuration 2 shown in FIG. 3, an inspection unit 301 is connected between the trimmer unit 110 and the stapler/tray unit 111. Print data 130 is sent from the host computer 121 to the printing control unit 102 via the LAN 122. Meanwhile, inspection data 131 is sent to the inspection unit 201 or 301 from the host computer 121 via the LAN 122. FIG. 2 illustrates a configuration used in the case where a printed paper is inspected prior to that printed paper being output to the stacker unit 107, after which a case-binding process and a folding process are carried out. Meanwhile, FIG. 3 illustrates the configuration used in the case where a final printed product that has been bound is output to the stapler/tray unit 111 without inspecting the printed paper.

Figure 4:
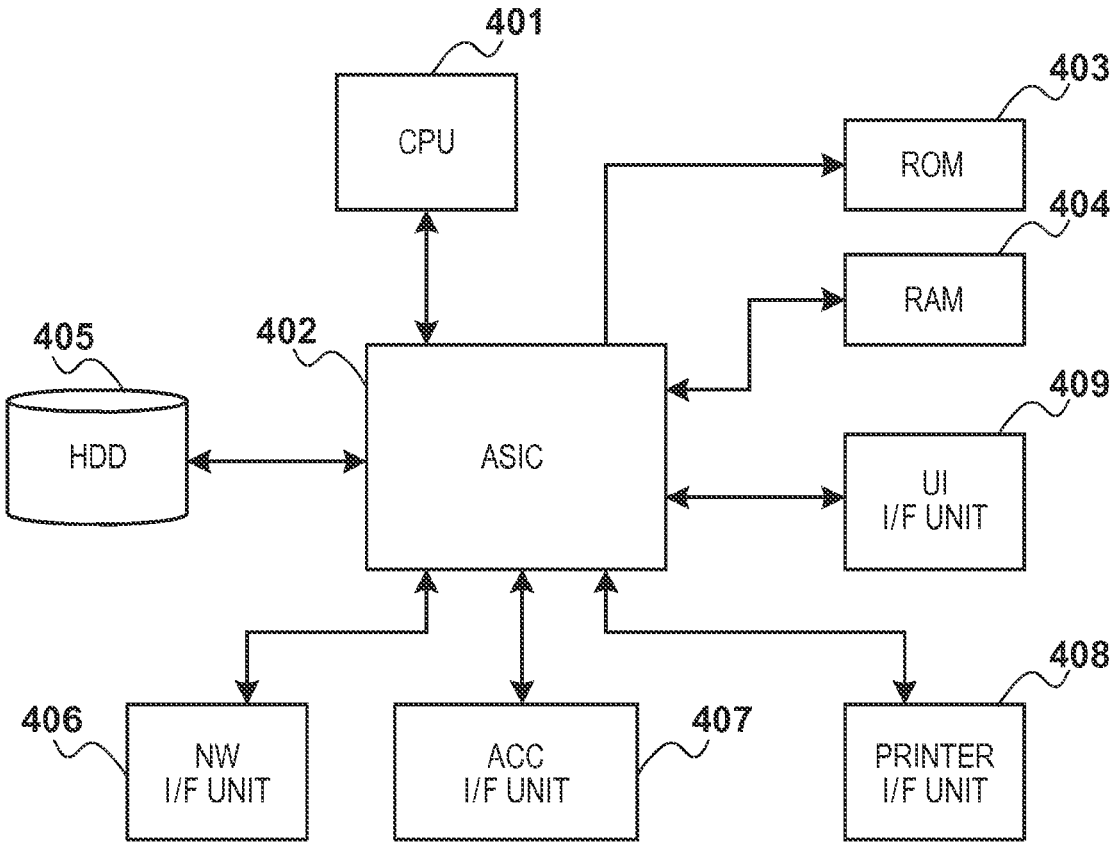
FIG. 4 is a block diagram illustrating the internal configuration of a printing control unit according to an embodiment.

FIG. 4 is a block diagram illustrating the internal configuration of the printing control unit 102 according to this embodiment.

A CPU 401 controls operations performed by the printing control unit 102. An ASIC (Application Specific Integrated Circuit) 402 is a custom IC for controlling connections between respective functional blocks within the printing control unit 102. A ROM 403 holds operating programs of the CPU 401. A RAM 404 provides a work area during control operations performed by the CPU 401, and is also used to temporarily hold various types of data. An HDD 405 is a hard disk drive serving as an external storage device (storage unit). A network interface (NW I/F) unit 406 performs interfacing control for connecting to the LAN 122. An accessory interface (ACC I/F) unit 407 performs interfacing control for connecting to the communication line 100. A printer interface unit 408 communicates with the printing unit 101 that performs printing. A UI I/F unit 409 is a user interface unit for communicating with the operation unit 103.

Next, operations performed by the accessory devices used for post-processing in the system illustrated in FIG. 1 will be described.

The multi-inserter unit 105 can insert multiple types of paper, such as heavy paper used as front and back cover paper, divider sheets, and so on, into the printed material printed by the printing unit 101. The puncher unit 106 can punch two holes, 26 holes, or the like in the end areas of the printed paper. The stacker unit 107 can stack and hold large amounts of the printed paper. The case-binding unit 108 can bind the paper that is printed on by the printing unit 101 through saddle stitching, gluing, or the like, using a sheet that encloses the printed paper as a cover. The folding unit 109 can perform various types of folding processes on the printed paper. The trimmer unit 110 can perform cutting processes. The stapler/ tray unit 111 can staple respective sets of the printed paper and stack those sets in an offset manner. A final printed product can be created by selecting these functions as desired and performing processes on the printed paper and on the sheets inserted from the multi-inserter unit 105.

Next, operations performed in the system configuration 1 shown in FIG. 2 for inspecting a job 1, in which divider sheets are inserted from the multi-inserter unit 105 while the printing unit 101 prints, filing punch holes are provided in the ends of the paper by the puncher unit 106, and the paper is held in the stacker unit 107, will be described.

Figure 5:
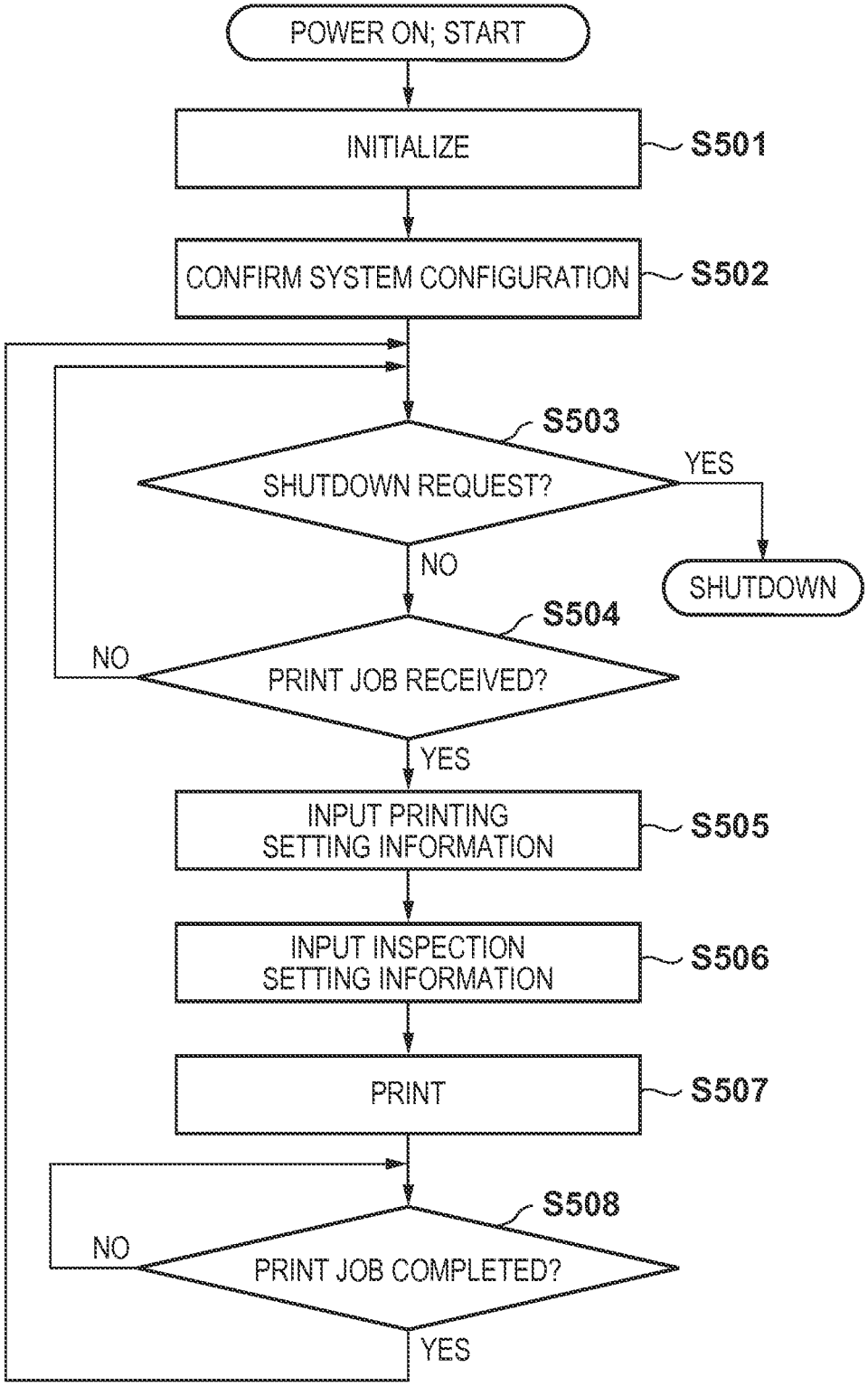
FIG. 5 is a flowchart illustrating processing performed by a printing system according to an embodiment.

FIG. 5 is a flowchart illustrating processing performed by the printing system according to this embodiment.

This processing is started by the printing system being turned on; first, in 5501, the CPU 401 of the printing control unit 102 initializes the printing unit 101 and the accessory devices, and then initializes the system as a whole. The processing then advances to S502, where the CPU 401 confirms the system configuration through communication based on addresses allocated to the respective accessory devices from pre-stored config information, in order to confirm the connection states of all of the connected accessory devices. A method that allocates unique addresses using DIP switches when the accessory devices are installed, a method that sets the addresses in connection order through daisy chaining, and so on can be considered for addressing the respective accessory devices. For example, in the case of the system configuration 1 shown in FIG. 2, the addresses are set as illustrated in Table 1. Here, connection relationships between the printing unit 101 and the respective accessory devices are shown, and addresses are assigned in ascending order from the upstream side based on the flow of the printed paper as defined by the anteroposterior relationships of the accessory devices (that is, the conveyance direction).

TABLE 1

System Configuration 1

| | Accessory Present/Absent | Address |
|---|---|---|
| Printing Unit | | 0 |
| Multi-inserter Unit | ○ | 1 |
| Puncher Unit | ○ | 2 |
| Inspection Unit | ○ | 3 |
| Stacker Unit | ○ | 4 |
| Case-binding Unit | ○ | 5 |
| Folding Unit | ○ | 6 |
| Trimmer Unit | ○ | 7 |
| Stapler/Tray Unit | ○ | 8 |

Meanwhile, in the case of the system configuration 2 shown in FIG. 3, the addresses are set as illustrated in Table 2.

TABLE 2

System Configuration 2

| | Accessory Present/Absent | Address |
|---|---|---|
| Printing Unit | | 0 |
| Multi-inserter Unit | ○ | 1 |
| Puncher Unit | ○ | 2 |
| Stacker Unit | ○ | 3 |
| Case-binding Unit | ○ | 4 |
| Folding Unit | ○ | 5 |
| Trimmer Unit | ○ | 6 |
| Inspection Unit | ○ | 7 |
| Stapler/Tray Unit | ○ | 8 |

Comparing Table 1 with Table 2, although the order in which the accessory devices are disposed is the same, the addresses of the accessory devices that follow the inspection unit change depending on the position at which the inspection unit is inserted.

The print data 130, which has been allocated to pages using application software in the host computer 121, is converted into print image data by a printer driver and is then sent to the printing control unit 102 via the LAN 122. Meanwhile, the inspection data 131 is output to the inspection unit 201. When the CPU 401 of the printing control unit 102 receives a job in S504, the processing advances to S505. In S505, the CPU 401 inputs the printing settings made by the user, after which the processing advances to S506, where the CPU 401 inputs inspection setting information (Table 5). When the user then sets divider sheets designated in that job (the job 1) in the multi-inserter unit 105 and instructs the printing to start, the CPU 401 starts printing using the printing unit 101 in S507. When all of the pages have been printed in S508, the processing returns to S503; if a shutdown request has been made, shutdown operations are performed. However, if there is no shutdown request, the processing advances to S504, where the system stands by for the next print job.

Figure 6:
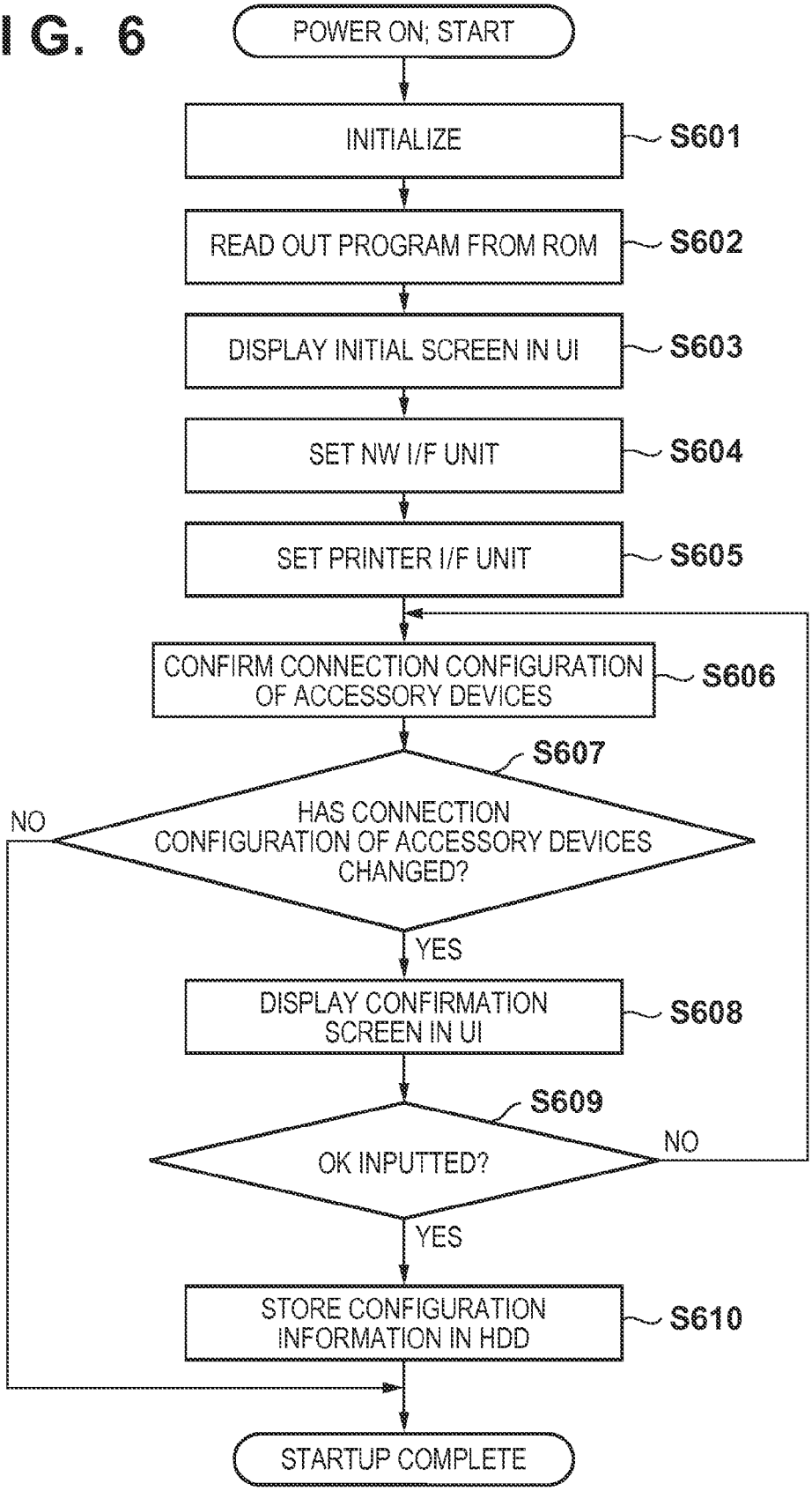
FIG. 6 is a flowchart illustrating a startup process performed by a printing control unit in a printing system according to an embodiment.

FIG. 6 is a flowchart illustrating a startup process of the printing control unit 102 in the printing system according to this embodiment.

This processing is started when the printing system is turned on; first, in S601, the CPU 401 initializes the respective blocks in the printing control unit 102, after which the processing advances to S602. In S602, the CPU 401 reads out an operation program from the ROM 403, and commences operations while using the RAM 404 as a work memory. The processing then advances to S603, where the CPU 401 first causes the UI I/F unit 409 to display an initial screen during startup in the display unit of the operation unit 103, and then change the display details in accordance with the status of the system and the operation details. The processing then advances to S604, where the CPU 401 sets the NW I/F unit 406 to be capable of sending and receiving data. Next, in 5605, the CPU 401 initializes the printer I/F unit 408, and then sets the printer I/F unit 408 to be capable of printing operations. The processing then advances to S606, where the CPU 401 initializes the ACC I/F unit 407, reads out system configuration information stored in the HDD 405, and confirms the connection configuration of the accessory devices. Here, in the case where there is a change to the system configuration, the processing advances from S607 to S608, where the CPU 401 displays a confirmation screen to the user. Then, in S609, when the user inputs "OK" indicating that s/he has confirmed the change, the CPU 401 stores the details of the change in the HDD 405. On the other hand, in the case where "OK" is not specified in S609, or in other words, if there is an instruction to retry, the processing returns to S606, where communication is carried out and the connections are confirmed.

In this manner, the printing control unit 102 can confirm the connection configuration of the accessory devices at startup, and can allow the user to confirm the connection configuration if a change has been made from a previous configuration.

Figure 7:
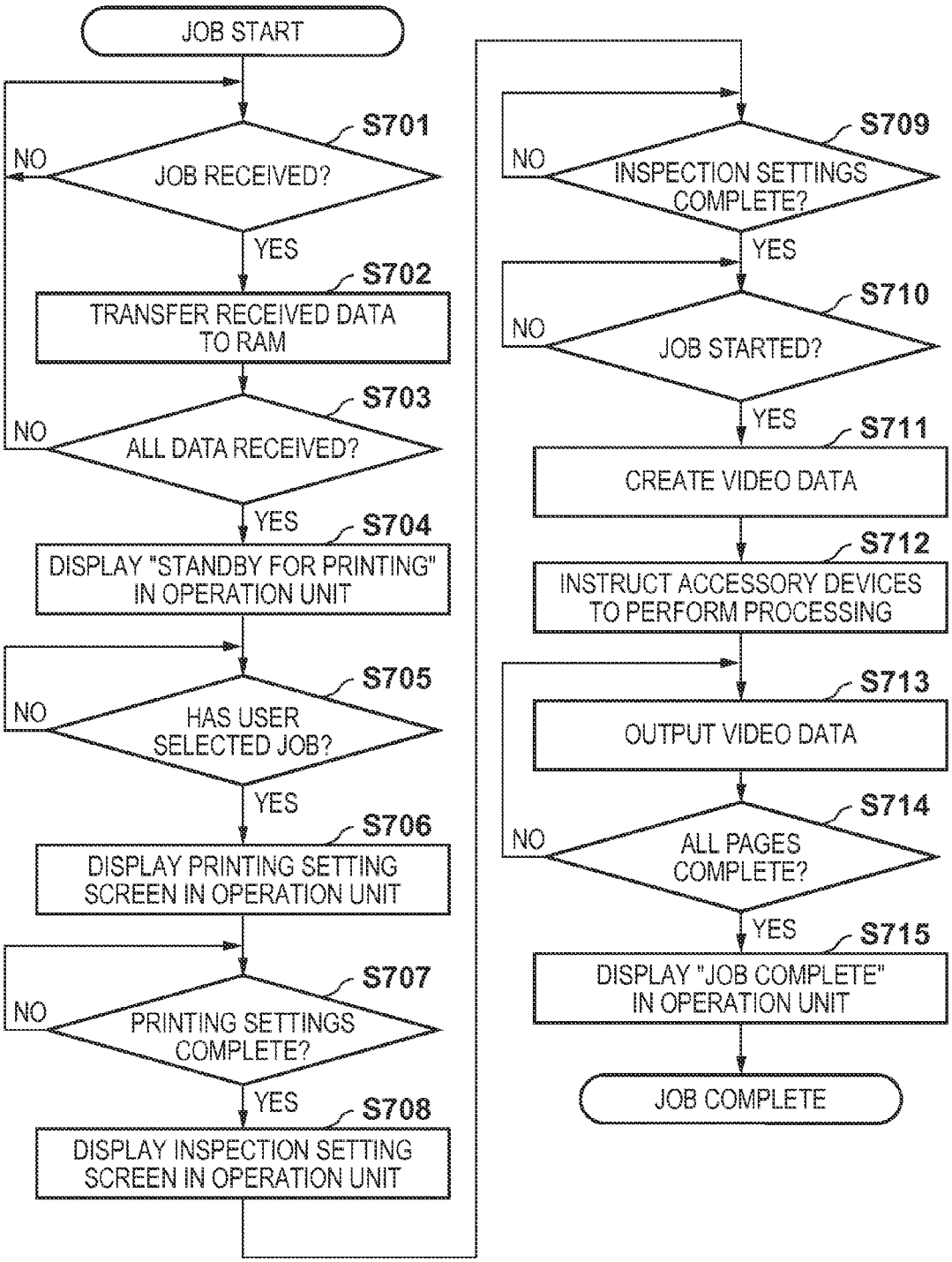
FIG. 7 is a flowchart illustrating processing of a job performed by a printing control unit in a printing system according to an embodiment.

Next, processing performed when the printing control unit 102 receives a job and carries out printing according to the present embodiment will be described with reference to the flowchart in FIG. 7. Note that the programs that execute this processing are stored in the ROM 403 and are executed under the control of the CPU 401.

When the CPU 401 determines that the NW I/F unit 406 has received a job in S701, the processing advances to S702, where the CPU 401 stores the received data in the RAM 404. When all of the data of that job has been received in S703, the processing advances to S704, where the CPU 401 causes the operation unit 103 to display a print standby screen via the UI I/F unit 409.

Then, when the CPU 401 determines in S705 that the user has selected a job, the processing advances to S706, where the CPU 401 displays a printing setting screen of that job in the display unit of the operation unit 103. Here, if the job is, for example, the job 1, the display instructs the user to set divider sheets in the multi-inserter unit 105, indicates that a hole-punching process has been specified, indicates that the holding destination is the stacker unit 107, and so on. Through this, the user confirms the printing settings, and then sets the divider sheets in the multi-inserter unit 105 in accordance with those settings; then, when the printing settings are completed, the processing advances from S707 to S708, where the CPU 401 displays a setting screen for setting inspection items in the display unit of the operation unit 103. When the user makes inspection settings using this setting screen, the inspection items therein are communicated to the inspection unit, and the inspection unit inspects the paper in accordance therewith. The processing then advances from S709 to S710, where the CPU 401 displays a job start screen. When the job is then instructed to be started, the processing advances to S711, where the CPU 401 starts the processing of the job.

In S711, the CPU 401 extracts print data and page control data from the received print job, and creates video data from the print data. The processing then advances to S712, where, based on the page control data, the related accessory devices are instructed of the details of the processing and the pages to be processed. For example, if the job is the job 1, a sheet feeding tray holding paper to be inserted and the pages where the paper is to be inserted are specified to the multi-inserter unit 105, the puncher unit 106 is instructed to punch holes in all of the pages, and the stacker unit 107 is instructed to stack all of the pages. The processing then advances to S713, where the CPU 401 sends the created video data to the printing unit 101 via the printer I/F unit 408, after which the printing is performed. Then, in S714, the CPU 401 outputs the video data until all of the pages have been printed; when all of the pages are held in the stacker unit 107, the processing advances to S715, where the user is notified that the job has ended by a display made in the display unit of the operation unit 103.

FIGS. 8A, 8B, 9A, and 9B are diagrams illustrating examples of displays made in the operation unit 103 when the job 1 is being processed.

FIG. 8A is a diagram illustrating an example of a setting screen of the job 1, and is a diagram illustrating information already set in the job 1, including the sheet feeding unit 104 and which accessory devices will be used. First, "L" for the sheet feeding unit 104 (in this example, there is only a single sheet feeding deck, and thus "deck 1" is selected) indicates a lower stage. The multi-inserter unit 105 is indicated as being used by "Y", and the details thereof indicate that "XX paper" is set in an upper stage "U". The puncher unit 106 is indicated as being used by "Y", and the details thereof indicate that 26 holes is selected. The inspection unit 201 is indicated as being used by "Y", and the arrow "→" indicates that there are detailed settings. For the stacker unit 107, "Y" indicates that sheets will be held in the stacker. The remaining accessory devices are connected and are thus displayed, but are not set to be used in the job 1, and are thus grayed out so as to be identifiable.

FIG. 8B is a diagram illustrating an example of the display of a detailed setting screen for the multi-inserter unit 105.

Figures 9A, 9B:
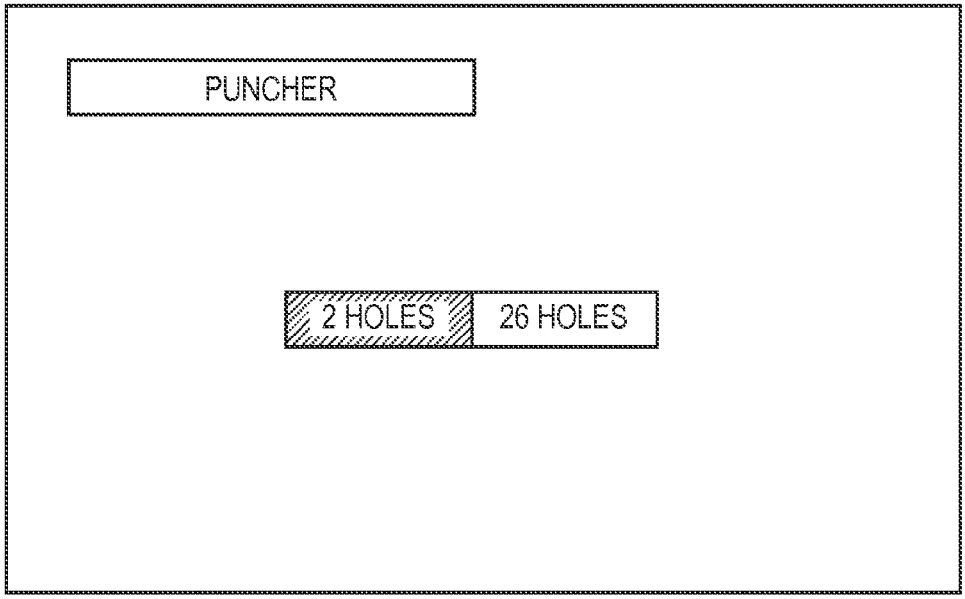
FIGS. 9A and 9B are diagrams illustrating setting examples for a puncher and an inspection unit when processing a job 1.

When the "details" for the multi-inserter unit in FIG. 8A is touched, the detailed setting screen of the multi-inserter unit shown in FIG. 8B is transited to. Here, a display indicating that "XX paper" is set in an insert deck 1 is carried out. Likewise, when the "details" for the puncher unit in FIG. 8A is touched, detailed settings for the puncher unit as indicated in FIG. 9A are displayed. FIG. 9A indicates that "26 holes" is selected as a job setting.

Furthermore, when "details" for the inspection unit as shown in FIG. 8A is touched, detailed settings for the inspection unit are displayed, as shown in FIG. 9B. In FIG. 9B, of inspection items "slanting", "blurring", "soiling", "front/back identification", "insert paper", "punching", and "trimming", all inspection items aside from "trimming" are set. In addition, and inspection setting level is set to "A", which is the strictest level, and "B", which is a less strict level. This setting information is set for that job at the time when the job is received, but can also be changed through the details screen. Furthermore, with respect to the inspection level setting, references are set for each item, and the items are indicated as "A", "B", and "C", from the strictest level down. "Slanting" indexes the slanting of an image relative to the paper, and the level is set based on the degree of the slant. "Soiling" is determined based on the area, darkness, and concentration of soiling. "Front/back identification" is determined based on content printed on the front surface and back surface (the presence/absence of vertical/horizontal lines in tables and the like) and an amount of slanting. In the present embodiment, descriptions regarding the details of the inspection levels will be omitted.

Here, a job in which divider sheets are inserted from the multi-inserter unit 105, punch holes used for filing are provided in the ends of the paper by the puncher unit 106, and the paper is held in the stacker unit 107 is taken as the job 1. Meanwhile, a job in which the printed paper is folded by the folding unit 109 is taken as a job 2, and a job that is cut by the trimmer unit 110 and output to the stapler/tray unit 111 is taken as a job 3. In the case where the respective jobs are to be processed by the system configuration 1 shown in FIG. 2 and the system configuration 2 shown in FIG. 3, Table 3 and Table 4 respectively indicate whether or not each of the accessory devices will be used.

Table 3 indicates whether or not the respective accessory devices will be used for the jobs 1 to 3 in the case of the system configuration 1 (FIG. 2).

TABLE 3

| System Configuration 1 | | | |
|---|---|---|---|
| | Whether or not device will be used depending on job | | |
| | Job 1 | Job 2 | Job 3 |
| Multi-inserter Unit | ○ | x | x |
| Puncher Unit | ○ | x | x |
| Inspection Unit | ○ | ○ | ○ |

TABLE 3-continued

| System Configuration 1 | | | |
|---|---|---|---|
| | Whether or not device will be used depending on job | | |
| | Job 1 | Job 2 | Job 3 |
| Stacker Unit | ○ | x | x |
| Case-binding Unit | x | x | x |
| Folding Unit | x | ○ | x |
| Trimmer Unit | x | x | ○ |
| Stapler/Tray Unit | x | x | ○ |

Meanwhile, Table 4 indicates whether or not the respective accessory devices will be used for the jobs 1 to 3 in the case of the system configuration 2 (FIG. 3).

TABLE 4

| System Configuration 2 | | | |
|---|---|---|---|
| | Whether or not device will be used depending on job | | |
| | Job 1 | Job 2 | Job 3 |
| Multi-inserter Unit | ○ | x | x |
| Puncher Unit | ○ | x | x |
| Stacker Unit | ○ | x | x |
| Case-binding Unit | x | x | x |
| Folding Unit | x | ○ | x |
| Trimmer Unit | x | x | ○ |
| Inspection Unit | NG | ○ | ○ |
| Stapler/Tray Unit | x | x | ○ |

As is clear from Table 3 and Table 4, with the system configuration 2, the inspection unit 301 is not used in the job 1, and is used only in the job 2 and the job 3.

Meanwhile, Table 5 indicates the inspection setting information set through the operation unit 103 in the system configuration 1, whereas Table 6 indicates the inspection setting information set through the operation unit 103 in the system configuration 2. Note that in Table 5 and Table 6, "–" indicates that it is not necessary for an accessory device to operate in the print job, grayed-out areas indicate items that cannot be inspected, and "A" and "B" indicate inspection levels.

TABLE 5

| System Configuration 1 | | | | | |
|---|---|---|---|---|---|
| Inspection Item | Job 1 | Inspection Item | Job 2 | Inspection Item | Job 3 |
| Slanting | A | Slanting | A | Slanting | A |
| Blurring | B | Blurring | B | Blurring | B |
| Soiling | A | Soiling | A | Soiling | A |
| Front/back Identification | B | Front/back Identification | B | Front/back Identification | B |
| Insert | A | Insert | – | Insert | – |
| Punching | B | Punching | – | Punching | – |
| Trimming | – | Trimming | – | Trimming | |

TABLE 6

| System Configuration 2 | | | | | |
|---|---|---|---|---|---|
| Inspection Item | Job 1 | Inspection Item | Job 2 | Inspection Item | Job 3 |
| Slanting | | Slanting | A | Slanting | A |
| Blurring | | Blurring | B | Blurring | B |
| Soiling | | Soiling | A | Soiling | A |
| Front/back Identification | | Front/back Identification | B | Front/back Identification | B |
| Insert | | Insert | – | Insert | – |
| Punching | | Punching | – | Punching | – |
| Trimming | – | Trimming | – | Trimming | A |

In Table 5, the settings are such that in the case where the job 1 is processed by the system configuration 1 (FIG. 2), "slanting", "blurring", "soiling", "front/back identification", and so on can be inspected, and the printed paper is held in the stacker unit 107. Accordingly, the inspection cannot be carried out unless "trimming" is also designated in the job 1, and thus the settings are as shown in Table 5. Meanwhile, when the job 1 is processed by the system configuration 2 (FIG. 3), the inspection unit 301 is located after the stacker unit 107, and thus "slanting", "blurring", "soiling", "front/back identification", and so on cannot be inspected; as a result, the settings are as shown in Table 6.

In the case where the job 2, in which folding is carried out by the folding unit 109, is processed by the system configuration 1, "slanting", "blurring", "soiling", "front/back identification", and so on can be inspected, but scanning, and consequently inspection, cannot be carried out after the processing by the folding unit 109; as a result, the settings are as shown in Table 5. Meanwhile, when the job 2 is processed by the system configuration 2, the inspection cannot be performed by the inspection unit 301 after the folding process performed by the folding unit 109, and thus the settings are the same as those in Table 5.

Although the setting items and the like differ from those in the job 1, the operations of the printing control unit 102 when the job 2 is processed are basically the same as the job 1, and thus descriptions thereof will be omitted.

In the case where the job 3, in which the paper is cut and is then output to the stapler/tray unit 111, is processed by the system configuration 1, "slanting", "blurring", "soiling", "front/back identification", and so on can be inspected, but because the inspection unit 201 is located before the trimmer unit 110, the result of the trimming cannot be inspected. Accordingly, the settings are as shown in Table 5. Meanwhile, when the job 3 is processed by the system configuration 2, the inspection unit 301 follows the trimmer unit 110, and it is thus possible to inspect the cut paper; accordingly, the settings are as shown in Table 6.

Although the above describes a configuration in which various types of accessory devices are connected in the system configuration 1, in the case where accessory devices aside from the inspection unit are removed, the post-processing of those accessory devices cannot be carried out.

Figure 10:
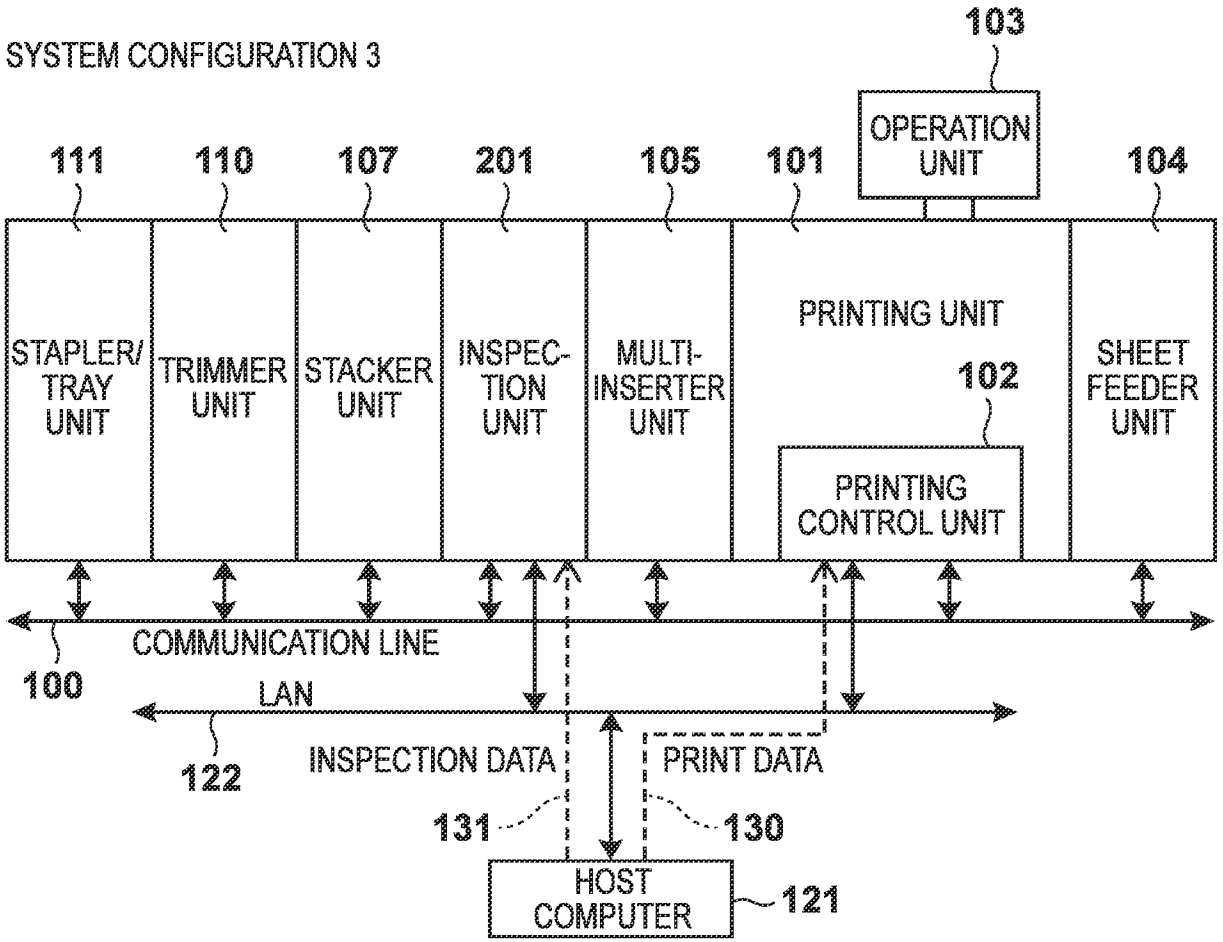
FIG. 10 is a block diagram illustrating a system configuration (a system configuration 3) realized by removing a puncher unit, a case-binding unit, and a folding unit from the system configuration 1 illustrated in FIG. 2.

The system configuration 3 in FIG. 10 illustrates an example of a configuration in which the puncher unit 106, the case-binding unit 108, and the folding unit 109 have been removed from the system configuration 1 shown in FIG. 2. In the system configuration 3 shown in FIG. 10, the addresses allocated to the respective accessory devices are indicated in Table 7.

TABLE 7

| System Configuration 3 | | |
|---|---|---|
| | Accessory Presence/Absence | Address |
| Printing Unit | | 0 |
| Multi-inserter Unit | ○ | 1 |
| Inspection Unit | ○ | 2 |
| Stacker Unit | ○ | 3 |
| Trimmer Unit | ○ | 4 |
| Stapler/Tray Unit | ○ | 5 |

Meanwhile, Table 8 indicates whether or not the respective accessory devices are used in the job 1, the job 2, and the job 3, in the case of the system configuration 3 shown in FIG. 10. Table 9 indicates the inspection setting information set through the operation unit 103 in the system configuration 3.

TABLE 8

| System Configuration 3 | | | |
|---|---|---|---|
| | Whether or not device will be used depending on job | | |
| | Job 1 | Job 2 | Job 3 |
| Multi-inserter Unit | ○ | x | x |
| Inspection Unit | ○ | ○ | ○ |
| Stacker Unit | ○ | x | x |
| Trimmer Unit | x | x | ○ |
| Stapler/Tray Unit | x | ○ | ○ |

TABLE 9

System Configuration 3

| Inspection Item | Job 1 | Inspection Item | Job 2 | Inspection Item | Job 3 |
|---|---|---|---|---|---|
| Slanting | A | Slanting | A | Slanting | A |
| Blurring | B | Blurring | B | Blurring | B |
| Soiling | A | Soiling | A | Soiling | A |
| Front/back Identification | B | Front/back Identification | B | Front/back Identification | B |
| Insert | A | Insert | – | Insert | – |
| Trimming | – | Trimming | – | Trimming | |

In the system configuration 3 shown in FIG. 10, the puncher unit 106 is no longer present, and thus the job 1 is a job in which divider sheets are inserted from the multi-inserter unit 105 and the printed paper is held in the stacker unit 107. Meanwhile, because the folding unit 109 is not present, the job 2 is a job in which the printer paper is output to the stapler/tray unit 111. Furthermore, in the job 3, the printed paper is directly cut by the trimmer unit 110 and output to the stapler/tray unit 111.

In this manner, when the presence/absence of the various types of accessory devices that configure the printing system is changed, it is necessary to change the job settings and the inspection settings in accordance therewith. Furthermore, because the details that can be inspected change depending on where the inspection unit is connected, it is also necessary to change the inspection items, details, and so on in accordance with the connection location, inspecting the printed material in accordance with those changes.

Figure 11:
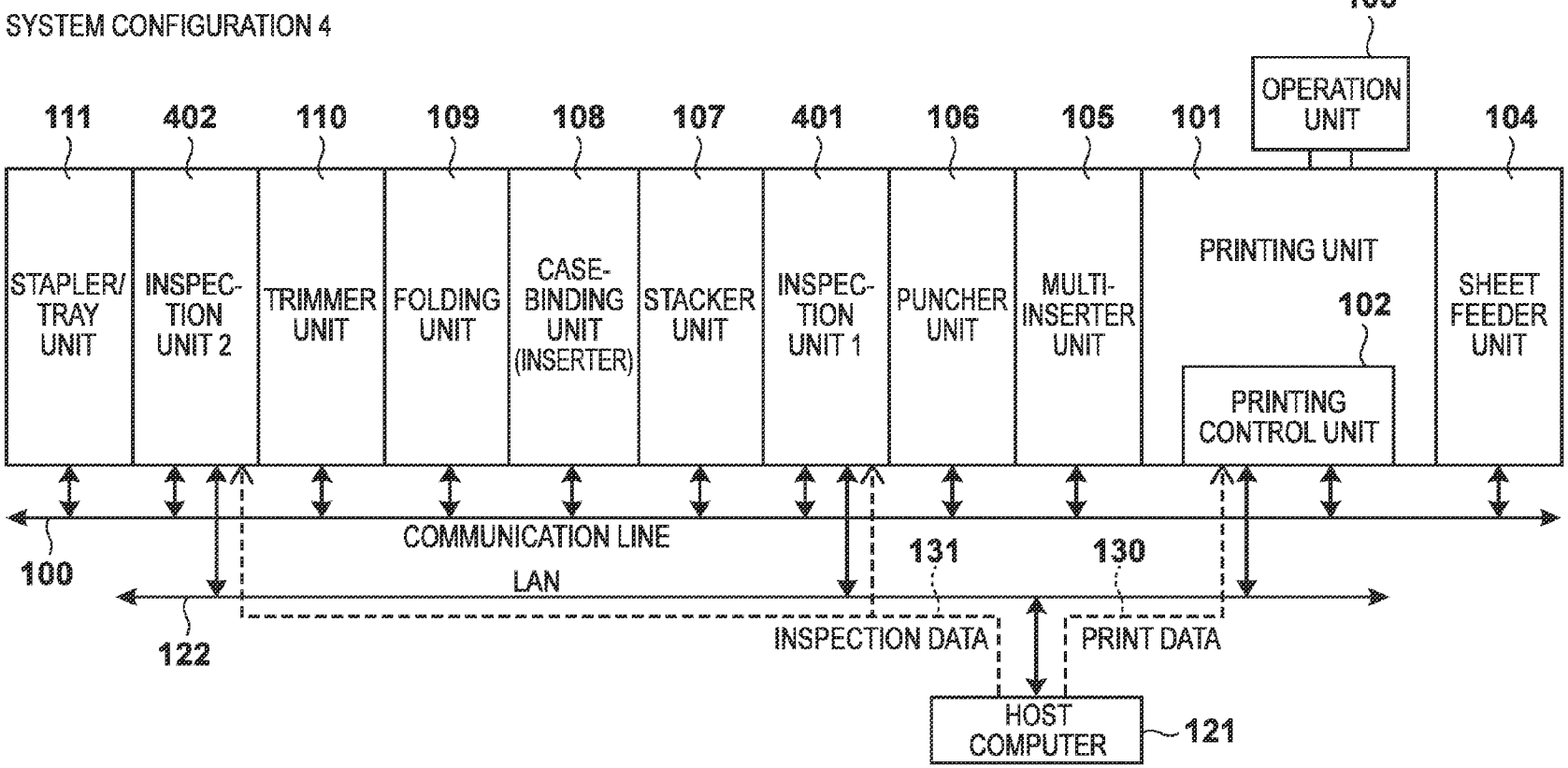
FIG. 11 is a block diagram illustrating a system configuration (a system configuration 4) in which an inspection unit 201 and an inspection unit 301, respectively illustrated in FIGS. 2 and 3, are disposed.

FIG. 11 is a block diagram illustrating a system configuration (a system configuration 4) in which the inspection unit 201 and the inspection unit 301, respectively illustrated in FIGS. 2 and 3, are disposed. The addresses allocated to the respective accessory devices in this configuration are indicated in Table 10.

TABLE 10

| System Configuration 4 and System Configuration 5 | | |
|---|---|---|
| | Accessory Present/Absent | Address |
| Printing Unit | | 0 |
| Multi-inserter Unit | ○ | 1 |
| Puncher Unit | ○ | 2 |
| Inspection Unit 1 | ○ | 3 |
| Stacker Unit 1 | ○ | 4 |
| Case-binding Unit | ○ | 5 |
| Folding Unit | ○ | 6 |
| Trimmer Unit | ○ | 7 |
| Inspection Unit 2 | ○ | 8 |
| Stapler/Tray Unit | ○ | 9 |

In this manner, depending on the connection position of the inspection unit, there are cases where the inspection details are changed, the inspection cannot be carried out, and so on. However, it is possible to address the situation by providing inspection units in two locations and using the operation unit 103 to designate which inspection unit is to inspect an image depending on the job to be printed. In this case, the inspection may be carried out using the designated inspection unit, and the other inspection unit may be used only to convey the paper to a later-stage accessory device.

Operations performed at this time will be described hereinafter.

Figure 12:
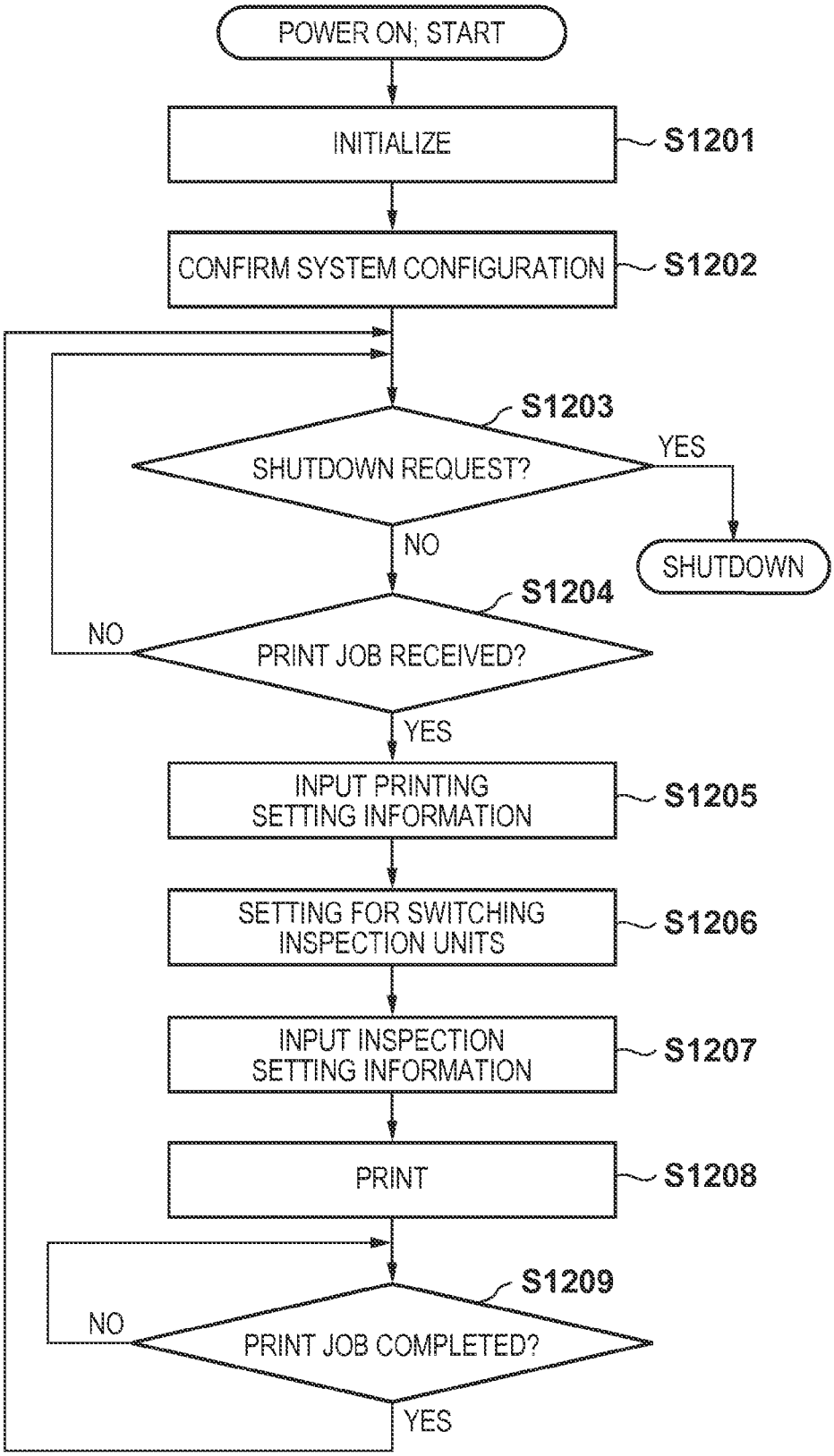
FIG. 12 is a flowchart illustrating operations performed by a printing control unit in an embodiment, in the case where the configuration of the printing system is the system configuration 4 illustrated in FIG. 11.

FIG. 12 is a flowchart illustrating operations performed by the printing control unit 102 according to this embodiment in the case where the configuration of the printing system is the system configuration 4 shown in FIG. 11.

This processing is started by the printing system being turned on; first, in S1201, the CPU 401 of the printing control unit 102 initializes the printing unit 101 and the accessory devices, and then initializes the system as a whole. The processing then advances to S1202, where the CPU 401 confirms the system configuration through communication based on addresses allocated to the respective accessory devices from pre-stored config information, in order to confirm the connection configuration of all of the connected accessory devices. After this, the print data 130, which has been allocated to pages using application software in the host computer 121, is converted into print image data by a printer driver and is then sent to the printing control unit 102 via the LAN 122. Meanwhile, the inspection data 131 is output to inspection units 401 and 402. In S1203, the CPU 401 performs shutdown operations if a shutdown request has been made; the processing advances to S1204 if no shutdown request has been made, and the system stands by to receive the next print job.

A job is received in S1204, and when the CPU 401 determines that all of the print data 130 of that received job has been received, the processing advances from S1204 to S1205, where the user makes printing settings. The processing then advances to S1206, where the inspection unit to be used is switched in accordance with the received job; the processing then advances to S1207, where inspection settings inputted by the user are accepted. At this time, for example, the user sets divider sheets designated in the received job in the multi-inserter unit 105. The CPU 401 then commences the printing in S1208. The processing then advances to S1209, and when the CPU 401 determines that all of the pages specified in that job have been printed, the processing advances to S1203.

Meanwhile, in the case where a plurality of inspection units are connected as shown in FIG. 11, for example, all of the inspection units may be provided only with scanner functionality for reading images and outputting image data, and only a single unit may then verify the images. In this case, it is possible to perform the inspection by verifying the images based on the image data output from the selected inspection unit.

Figure 13:
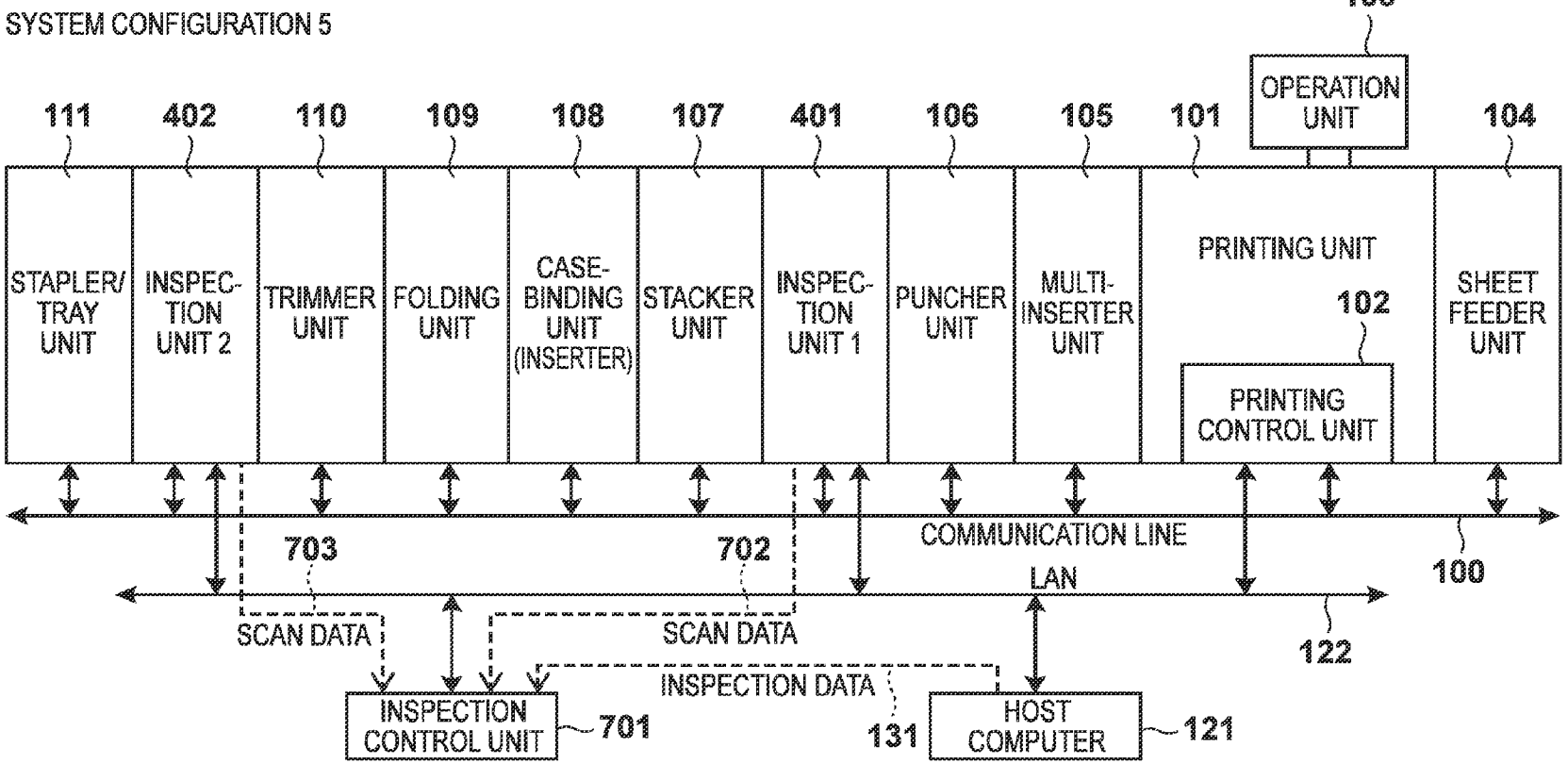
FIG. 13 is a block diagram illustrating a system configuration in which an inspection control unit that performs a verification function has been added to the system configuration shown in FIG. 11.

FIG. 13 is a block diagram illustrating a system configuration in which an inspection control unit 701 that performs a verification function has been added to the system configuration shown in FIG. 11.

In the configuration shown in FIG. 13, the inspection control unit 701 receives the inspection data 131 from the host computer 121, and receives scan data (image data) 702 and 703 obtained by the inspection units 401 and 402 respectively scanning the printed paper. The state of the printed paper can then be inspected by the respective inspection units 401 and 402, and the results of the inspection can be sent to the host computer 121 via the LAN 122.

The above describes connecting two inspection units in separate locations, inspecting the printed material using only one of the inspection units, and using the other inspection unit only to convey the paper. However, it is of course possible to inspect the printed material using two inspection units.

The above has described the necessity to change inspection settings depending on the connection positions of the inspection units in the printing system. Next, a process for obtaining the inspection data from print data allocated to pages by application software in the host computer 121 will be described.

Figure 14A:
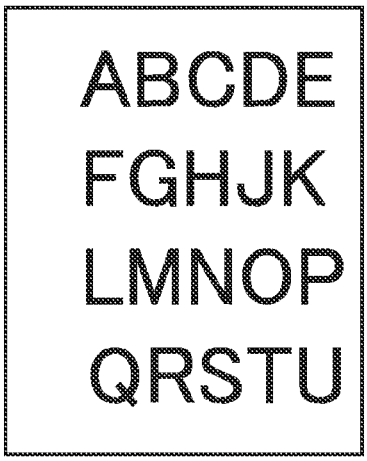
FIGS. 14A to 14E are diagrams illustrating print data and inspection data that is changed in accordance with post-processing.
Figure 14B:
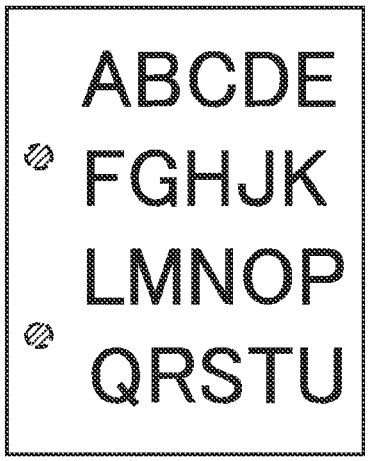
Figure 14C:
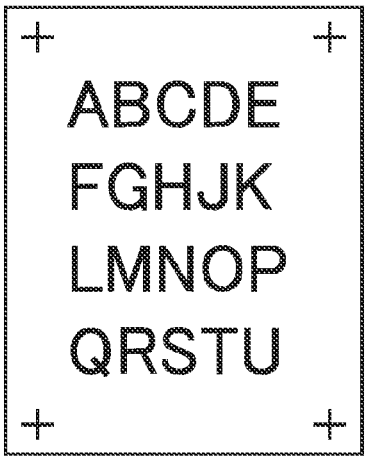
Figure 14D:
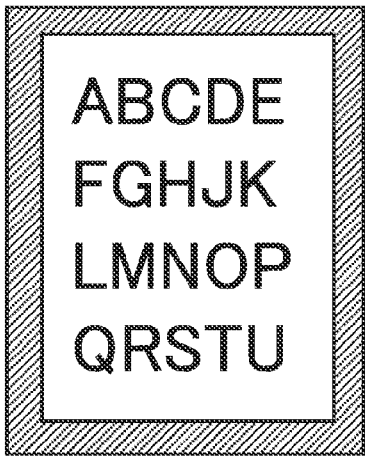

FIGS. 14A and 14C are diagrams illustrating examples of the print data 130 output from the host computer 121. FIG. 14B illustrates the inspection data in the case where holes are to be punched by the puncher unit 106, and FIG. 14D illustrates the inspection data in the case where the paper is to be cut by the trimmer unit 110.

The areas of the two holes shown in FIG. 14B are areas where it can be expected that holes are present when reading the paper using the inspection unit, and are regions that are ignored during verification. According to the configuration described in the present embodiment, the puncher unit 106 is located before the inspection units 201 and 401, and thus the inspection data is created and verification is carried out as described above if the punching process is set.

FIG. 14C, meanwhile, illustrates an example of print data in which plus signs serving as indicators for cutting are drawn. In the case of inspection using the system configuration 1 illustrated in FIG. 2, the printed paper is inspected before cutting, and thus as shown in FIG. 14D, areas of the paper that are to be cut, indicated by shading, are ignored, and the verification is carried out on the areas aside from the shaded areas.

Figure 14E:
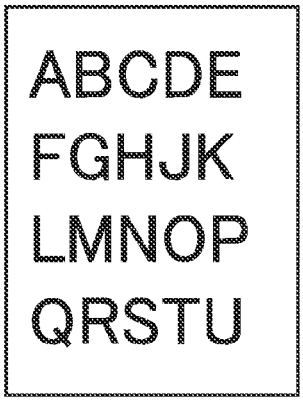

Meanwhile, in the case of inspection using the system configuration 2 shown in FIG. 3, the paper is read after the cutting, and thus post-cutting inspection data, shown in FIG. 14E, is created and verified.

The inspection data is created by the host computer 121 based on the post-processing settings and the inspection settings for the inspection unit in the print data as well as the connection position of the inspection unit, and is then output to the inspection unit. Meanwhile, it is also possible for the inspection unit to create the inspection data from the print data output from the host computer 121, based on the post-processing settings and the inspection settings for the inspection unit as well as the connection position of the inspection unit.

Last, an inspection process in the case where paper is inserted using the multi-inserter unit 105 will be described.

In the case where divider sheets are inserted, the paper type thereof is registered in advance in the host computer 121 and the inspection unit, and that paper type is designated when inputting the printing setting information and the inspection setting information. Through this, inspection can be performed by linking paper information of the inserted paper designated in the job with the paper that is inserted. Meanwhile, in the case where printed paper is inserted, a printed image is saved in the host computer 121 in the case where the inserted paper has been printed, or a printed image is transferred from another device and is designated as an inserted page in printing allocation information for the job. In this manner, the print job is created from the print data, image data of the inserted pages, and the page allocation information, and the printing and inspection are carried out based on the data of the print job.

As described above, in a printing system in which various accessory devices are connected and used, image data obtained by reading printed paper will differ depending on post-processing performed by the accessory devices. Accordingly, as described in the present embodiment, in the case where an inspection unit is connected as an accessory device, it is necessary to change the details that are inspected depending on where the inspection unit is disposed. According to the present embodiment, in a printing system in which various accessory devices are connected, the freedom of the position where an inspection apparatus is disposed can be increased, and the convenience can be increased for a user as a result.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-128401, filed Jun. 5, 2012, which is hereby incorporated by reference herein in its entirety.

What is claimed is:

1. An inspection system including a printing apparatus that performs print processing, a post-processing apparatus that performs post-processing on a sheet for which the print processing has been performed, and an inspection apparatus that inspects the sheet for which the print processing has been performed, the inspection system comprising:

a confirming unit configured to confirm a connection configuration between the post-processing apparatus and the inspection apparatus; and a determining unit configured to determine an inspection item to be inspected by the inspection apparatus based on the connection configuration confirmed by the confirming unit, wherein in a case where a specific post-processing apparatus that performs specific post-processing is provided upstream from the inspection apparatus, the determining unit determines the specific post-processing as the inspection item.

2. The inspection system according to claim 1, wherein the specific post-processing apparatus is a cutting device that performs cutting processing for the sheet for which the print processing has been performed, and in a case where the cutting device is provided upstream from the inspection apparatus, the determining unit determines the cutting processing as the inspection item.

3. The inspection system according to claim 2, wherein the inspection apparatus inspects the sheet for which the cutting processing has been performed.

4. The inspection system according to claim 1, wherein the inspection system includes plural types of post-processing apparatuses, and the confirming unit confirms the connection configuration between each of the plural types of post-processing apparatuses and the inspection apparatus.

5. A control method for controlling an inspection system including a printing apparatus that performs print processing, a post-processing apparatus that performs post-processing on a sheet for which the print processing has been performed, and an inspection apparatus that inspects the sheet for which the print processing has been performed, the method comprising steps of:

confirming a connection configuration between the post-processing apparatus and the inspection apparatus; and determining an inspection item to be inspected by the inspection apparatus based on the connection configuration confirmed in the confirming step wherein in a case where a specific post-processing apparatus that performs specific post-processing is provided upstream from the inspection apparatus, the specific post-processing is determined as the inspection item in the determining step.

* * * * *